US007882674B2

(12) United States Patent
Craven et al.

(10) Patent No.: US 7,882,674 B2
(45) Date of Patent: Feb. 8, 2011

(54) BUILDING BLOCKS AND WALL ASSEMBLY UTILIZING SAME

(76) Inventors: Joseh H. Craven, 8416 Sunset Dr., Wonder Lake, IL (US) 60097; Sara Craven, 8416 Sunset Dr., Wonder Lake, IL (US) 60097; Frank L. McKenzie, 4N620 Chaffield Dr., St. Charles, IL (US) 60175

( * ) Notice: Subject to any disclaimer, the term of this patent is extended or adjusted under 35 U.S.C. 154(b) by 230 days.

(21) Appl. No.: 11/608,652

(22) Filed: Dec. 8, 2006

(65) Prior Publication Data

US 2008/0134616 A1 Jun. 12, 2008

(51) Int. Cl.
*E04C 2/32* (2006.01)

(52) U.S. Cl. ..... 52/606; 52/604; 52/284; 52/570; 52/561; 446/128; 446/124

(58) Field of Classification Search ..... 52/604, 52/606, 503, 504, 570, 284, 561; 446/124, 446/128

See application file for complete search history.

(56) References Cited

U.S. PATENT DOCUMENTS 221,127 A * 10/1879 Walker ..... 52/218
708,499 A 9/1902 Searight et al.
803,380 A * 10/1905 Wickre ..... 52/605
860,565 A * 7/1907 Peetz ..... 52/505
894,122 A 1/1908 Dougherty
1,171,191 A * 2/1916 Gronert ..... 52/591.1
1,296,527 A * 3/1919 Keasbey ..... 52/504
1,336,025 A * 4/1920 Cook ..... 138/115
1,432,068 A 10/1922 Jones
1,458,888 A * 6/1923 Knapen ..... 138/115
1,676,385 A 7/1928 Colwell
2,474,948 A * 7/1949 Landrigan ..... 52/375
2,644,327 A 7/1953 Clements
2,852,933 A * 9/1958 Amundson ..... 52/405.1
3,204,381 A * 9/1965 Perreton ..... 52/309.12
3,247,633 A * 4/1966 Schultz et al. ..... 52/204.1
3,534,518 A 10/1970 Zagray
3,982,369 A * 9/1976 Keleske ..... 52/309.12
4,075,808 A * 2/1978 Pearlman ..... 52/439
4,148,166 A 4/1979 Toone
4,172,344 A * 10/1979 Childress et al. ..... 52/98
4,184,166 A 1/1980 Olson (Continued)

OTHER PUBLICATIONS

International Searching Authority/US, PCT International Search Report, International Application No. PCT/US07/84072, May 24, 2008.

(Continued)

*Primary Examiner*—Robert J Canfield
*Assistant Examiner*—Matthew J Gitlin
(74) *Attorney, Agent, or Firm*—Beem Patent Law Firm

(57) ABSTRACT

Molded concrete building blocks consisting of three block walls and block webs so located as to provide an increased path through the width of the block to reduce transmission of thermal and acoustic energy. The blocks may incorporate features, e.g., male projections and female recesses or an offset inner wall, so that mortar may not be required for assembly. The blocks may be configured so that interior apertures may be vertically aligned when the blocks are assembled in courses, providing adaptability to structure enhancing reinforcement and insulation materials, and to interior wall installation of wiring and plumbing.

4 Claims, 5 Drawing Sheets

U.S. PATENT DOCUMENTS

| | | | | | |
|---|---|---|---|---|---|
| 4,185,434 | A | * | 1/1980 | Jones | 52/405.1 |
| 4,295,313 | A | | 10/1981 | Rassias | |
| 4,319,440 | A | * | 3/1982 | Rassias et al. | 52/438 |
| 4,565,043 | A | * | 1/1986 | Mazzarese | 52/592.6 |
| 4,854,103 | A | | 8/1989 | Klym | |
| 5,241,795 | A | * | 9/1993 | Giroux et al. | 52/503 |
| 5,457,926 | A | * | 10/1995 | Jensen | 52/604 |
| 5,575,128 | A | | 11/1996 | Heener | |
| 5,678,958 | A | * | 10/1997 | Rossi | 405/286 |
| 5,715,635 | A | | 2/1998 | Sherwood | |
| 5,901,520 | A | * | 5/1999 | Abdul-Baki | 52/592.6 |
| 5,987,840 | A | | 11/1999 | Leppert | |
| 6,145,267 | A | | 11/2000 | Pardo | |
| 6,244,009 | B1 | * | 6/2001 | Cerrato | 52/604 |
| 6,539,682 | B1 | * | 4/2003 | Ryder | 52/437 |
| 6,550,208 | B2 | * | 4/2003 | Nanayakkara | 52/606 |
| 6,579,038 | B1 | * | 6/2003 | McAllister et al. | 405/16 |
| 6,665,994 | B1 | * | 12/2003 | Ruggeri | 52/592.6 |
| 6,799,405 | B2 | | 10/2004 | Gilbert | |
| 7,108,577 | B2 | | 9/2006 | Peters et al. | |
| 2005/0178081 | A1 | | 8/2005 | Bott | |

OTHER PUBLICATIONS

Mortarless Block Systems—An analysis of the six systems on the market (4 pages).

International Bureau PCT Notification Concerning Transmittal of International Preliminary Report on Patentability, IB mailing date Jun. 18, 2009; including International Preliminary Report on Patentability and Written Opinion of the International Searching Authority PCT/US2007/084072; 9 pages.

* cited by examiner

BUILDING BLOCKS AND WALL ASSEMBLY UTILIZING SAME

BACKGROUND OF THE INVENTION

1. Field of the Invention

The present invention relates to the construction arts, and particularly to building blocks of a type that can be assembled.

2. Related Applications

Applicants previously filed application Ser. No. 09/300,364 (abandoned), which contained some of the information presented herein. Applicants do not claim priority based upon application Ser. No. 09/300,364.

3. Description of the Related Art

The contemporary demands on the design and construction arts remain the elemental ones: to avoid discomforts caused by excesses of heat or cold or by intrusions of rain, wind, fire or vermin; to be durable, sturdy, and easily maintained; and to be pleasing and attractive in appearance.

Early civilizations recognized stone as a most desirable construction material. When available, stone was incombustible, impenetrable by then-known weapons, could be expected to endure, and could be shaped into usable form. The use of stone diminished over time due to development of other materials that were more amenable to fabrication and assembly in our industrialized era.

In the $19^{th}$ century, it was discovered that concrete block "stones" having larger overall dimensions could be made and easily handled when the blocks were vertically hollowed, thus reducing weight and providing adequate bearing strength for the erection of structures. These concrete blocks have traditionally and customarily been erected by use of mortar being placed between adjacent block surfaces, which practice demands the highly trained, and relatively expensive skills of the masonry artisan. Thus, with the relative cost of constriction becoming an element of increasing concern, the use of masonry materials declined significantly over the past decades.

Additionally, the relatively recent increase in awareness of the need for conserving energy and natural resources, and reducing noise and noxious pollution, has accelerated the demand for improvements in construction techniques and materials.

The use of building blocks in the construction art is well established. The blocks, usually of concreted material, are precast at a manufacturing facility, and subsequently transported to a construction site. For erection of walls, building foundations, fences, noise barriers, and like structures, the blocks are placed in end-to-end alignment in rows, commonly referred to as courses. The first course is generally placed upon a pre-prepared base. A second course is placed in staggered alignment upon the first course. Additional courses are added until the desired height of the structure is achieved. The courses are staggered so that the abutment between the two adjacent blocks is approximately centered over a single block of a successively lower course.

Those blocks that are utilized in the centers of courses, and which constitute the majority of block configurations, are customarily referred to as stretchers. Those blocks that are utilized at the ends of courses, such as at wall corners and door or window openings, are customarily referred to as end stretchers. And where required by design dimension constraints or at certain wall end locations, blocks of approximately one-half the length of stretchers are utilized, and are customarily referred to as half blocks.

Reduction of construction costs may be realized by utilization of concrete building block components which do not require the high cost and rarely available skills of the masonry artisans. A mortarless, or "dry stacked," concrete building block design addresses this required cost effectiveness.

A review of known prior art discloses a number of designs of interlocking and mortarless building block designs which have universally failed to gain widespread acceptance by the public, the architectural designers, or the constructors. Many of these building block designs are highly complex, and require completely new and expensive fabrication equipment to manufacture. Additionally, the more complex the design, the greater care must be exercised in handling of the blocks, and the greater the irreparable damage in transit and at the erection site, all of which render these blocks to be expensive.

These known prior art designs universally provide straight linear horizontal paths, or slightly offset linear horizontal paths, through the blocks for the unrestricted transmission by conduction of thermal and acoustic energy. The addition of externally installed thermal and acoustic insulating materials is required in order to achieve the desired insulating characteristics in finished structures, which may result in higher construction costs.

Some of the prior alit designs are incompatible with traditional conventional construction systems and materials, thus rendering them unacceptable for renovation rehabilitation, or expansion construction of existing structures.

There exists a need for a construction block which may reduce the cost associated with the erection of high quality, long lasting structures, which may provide significant thermal and acoustic insulation qualities, which may be assembled by semi-skilled labor, which may be strengthened to withstand extreme wind, earthquake, and similar natural phenomena, which may have improved lateral strength and stability, of erected strictures, which may be rot, rust and vermin proof, which may be compatible with a wide range of architectural aesthetic treatments, and which largely may be produced by existing manufacturing equipment.

BRIEF SUMMARY OF THE INVENTION

A construction block is provided for use in the construction of bearing and non-bearing walls, partitions, building foundations, fences, noise-barriers, and other similar structures. The block includes three generally rectangular walls of generally the same size that are spaced generally parallel to one another, two of the walls being outer walls, each having an inner face and an outer face, and one of the walls being an inner wall. Each of the walls has a first short side, a second short side, a first long side and a second long side. The block further includes at least four generally planar webs that are generally perpendicular to the walls, wherein the webs are spaced generally parallel to one another. Two of the webs are positioned between a first outer wall and the inner wall so as to connect the first outer wall and the inner wall, and two of the webs are positioned between a second outer wall and the inner wall so as to connect the second outer wall and the inner wall. The webs are arranged to form a linear path having a distance front the outer face of the first outer wall to the outer face of the second outer wall, wherein the distance of the linear path is at least about 10% greater than the shortest distance between the outer face of the first outer wall and the outer face of said second outer wall.

Additionally, the construction block of the current invention may be used without mortar. For example, in one embodiment at least one of the walls may have at least one projection on its first long side and at least one recess on its second long side for receiving a similar projection. Accordingly, when like blocks are stacked, the projections interlock with the recess to align the blocks and provide lateral strength and stability. In another embodiment, the inner wall is vertically offset from the outer walls, which aligns like blocks when stacked and provides lateral strength and stability.

A wall system using construction blocks is provided. The wall system comprises a plurality of stretcher blocks, wherein each stretcher block comprises three generally rectangular walls of generally the same size that are spaced generally parallel to one another, two of the walls being outer walls, each having an inner face and an outer face, and one of the walls being an inner wall, wherein the walls have a first short side, a second short side, a first long side and a second long side. Each stretcher block further comprises at least four generally planar webs, the webs being generally perpendicular to the walls, wherein the webs are spaced generally parallel to one another, wherein two of the webs are positioned between a first outer wall and the inner wall so as to connect the first outer wall and the inner wall, and two of the webs are positioned between a second outer wall and the inner wall so as to connect the second outer wall and the inner wall. The webs are arranged to form a linear path having a distance from the outer face of the first outer wall to the outer face of said second outer wall, wherein the distance of the linear path is at least about 10% greater than the shortest distance between the outer face of the first outer wall and the outer face of the second outer wall. The stretcher blocks are assembled so that a first stretcher block will align with an adjacent block.

A construction block is provided. The block includes three generally rectangular walls of generally the same size that are spaced generally parallel to one another, two of the walls being outer walls and one of the walls being an inner wall. The walls have a first short side, a second short side, a first long side and a second long side. The first short sides of each of the walls are generally in the same plane, and the first long sides of each of the walls are generally in the same plane. At least one of the walls has at least one projection on its first long side and at least one recess on its second long side for receiving a similar projection. The block further includes at least four generally planar webs, the webs being generally perpendicular to the walls. The webs are spaced generally parallel to one another, wherein two of the webs are positioned between a first outer wall and the inner wall so as to connect the first outer wall and the inner wall, and two of the webs are positioned between a second outer wall and the inner wall so as to connect the second outer wall and the inner wall.

These and other features and advantages are evident from the following description of the present invention, with reference to the accompanying drawings.

DETAILED DESCRIPTION OF THE ILLUSTRATED EMBODIMENTS

Figure 1:
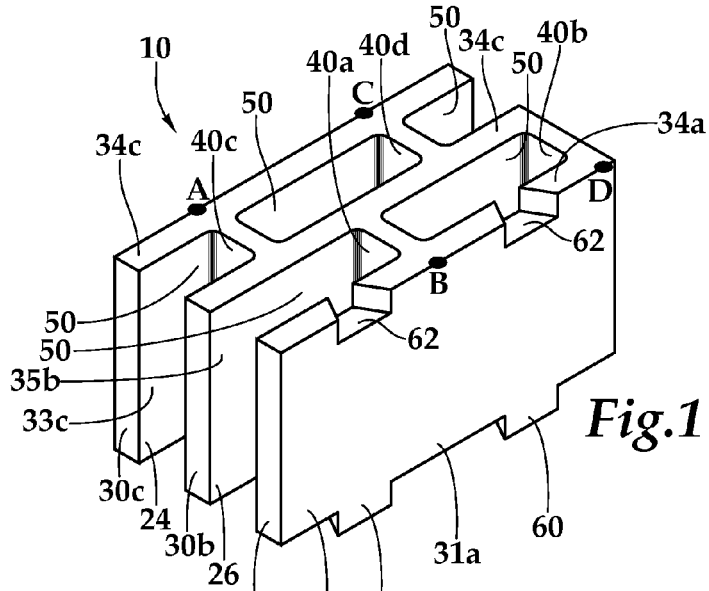
FIG. 1 is a perspective view of a construction block of one embodiment of the invention.
Figure 2:
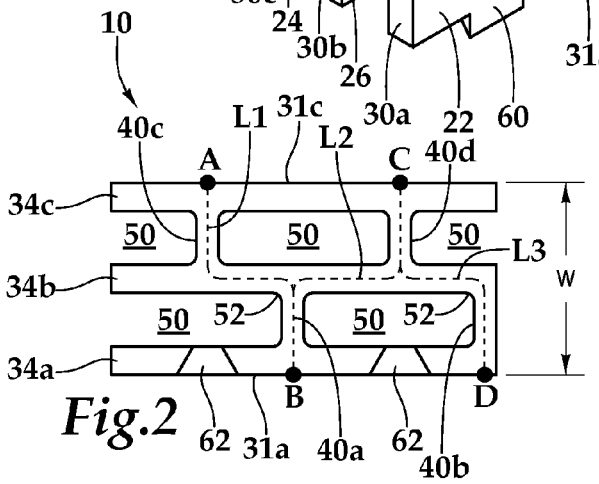
FIG. 2 is a top view of the construction block of FIG. 1.
Figure 3:
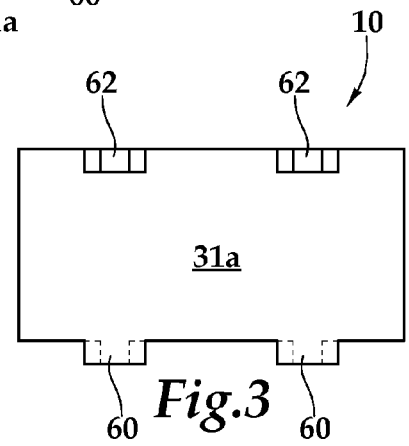
FIG. 3 is a front view of the construction block of FIG. 1.

FIGS. 1-3 show one embodiment of a construction block 10 for use in the construction of bearing and non-bearing, walls, partitions, building foundations, fences, noise-barriers, and other similar structures. Construction block 10 includes three generally rectangular walls 22, 24, 26, four generally planar webs 40*a*, 40*b*, 40*c*, 40*d* that are positioned between the walls 22, 24, 26, and two projections 60 and two recesses 62 for receiving projections 60 of a like block.

Walls 22, 24, 26 consist of a first outer wall 22, a second outer wall 24 and an inner wall 26 between the two outer walls 22 and 24. The walls 22, 24, 26 are spaced generally parallel to one another. Preferably, the inner wall 26 is generally centered between the first outer wall 22 and the second outer wall 24, but the positioning of inner wall 26 between outer walls 22 and 24 may vary if desired.

Outer wall 22 has an outer face 31*a* and an inner face opposite outer face 31*a*, outer wall 24 has an outer face 33*c* and an inner face opposite outer face 33*c*, and inner wall 26 similarly has a first face 35*b* and a second face opposite first face 35*b*, all of which are generally planar and rectangular in shape.

Outer wall 22 has a first short side 30*a* and a first long side 34*a*, inner wall 26 has a first short side 30*b* and a first long side 34*b*, and outer wall 24 has a first short side 30*c* and a first long side 34*c*. First short sides 30*a*, 30*b*, 30*c* of walls 22, 24, 26 are generally in the same plane, and the first long sides 34 of walls 22, 24, 26 are also generally in the same plane. Walls 22, 24, 26 similarly have second short sides opposite first long sides 30*a*, 30*b*, 30*c*, and second long sides opposite first long sides 34*a*, 34*b*, 34*c*.

While the dimensions of walls 22, 24, 26 may vary, it is desirable for block 10 to conform to the industry standard dimensions of 8 inches by 8 inches by 16 inches. First short sides 30*a*, 30*b*, 30*c* preferably are between about 4 inches and about 10 inches in length, and more preferably are about 8 inches in length. The first long sides 34*a*, 34*b*, 34*c* preferably are between about 14 inches and 18 inches in length, and more preferably are about 16 inches in length.

Walls 22, 24, 26 are of adequate thickness so that they may facilitate stability in molding and they may provide adequate load bearing surface when blocks are stacked. The thickness of the walls 22, 24, 26 is preferably between about ½ inch and about 1½ inches, and more preferably is about 1 inch. It is preferred that the wall thickness is uniform, but the thickness may vary. For example, walls 22, 24, 26 may be slightly tapered if desired to facilitate molding operations during block manufacturing.

As shown in FIG. 2, webs 40*a*, 40*b*, 40*c*, 40*d* are preferably arranged so as to increase the linear distance from first outer wall 22 to second outer wall 24, which may reduce the transmission of acoustic and thermal energy from one outer wall to the other through the material comprising the walls 22, 24, 26 and webs 40*a*, 40*b*, 40*c*, 40*d*.

In FIG. 2, Point A represents a location on outer face 31*a* of outer wall 22, and point B represents a location on outer face 31*b* of outer wall 24. The linear path L1 between outer wail 22 and outer wall 24 is represented by a dotted line. Thermal and acoustic energy may travel along path L1 in either direction. Preferably, the length of linear path L1 between point A and point B is at least about 10% greater than the shortest distance W between outer face 31*a* of outer wall 22 and outer face 31*b* of outer wall 24, i.e., the width of the block, and more preferably it is about 7-5% greater, and still more preferably it is about 50% greater than distance W.

Two additional linear paths are shown in FIG. 2. One is a path L2 from point C to point B, and the other is a path L3 from point C to point D. The preferred lengths of paths L2 and L3, respectively, are the same as for path L1. As shown, paths L1, L2, and 1L3, which are of about equal length, represent the shortest linear paths between outer face 31*a* and outer face 31*b*.

Webs 40*a*, 40*b*, 40*c*, 40*d* are positioned between walls 22, 24, 26 and are spaced generally parallel to one another, as shown in FIG. 2. Webs 40*a*, 40*b*, 40*c*, 40*d*, which connect walls 22, 24, 26, are preferably perpendicular to walls 22, 24, 26, but the angle between webs 40*a*, 40*b*, 40*c*, 40*d* and walls 22, 24, 26 may vary if desired. A first web 40*a* and a second web 40*b* are positioned between first outer wall 22 and inner wall 26, and a third web 40*c* and a fourth web 40*d* are positioned between second outer wall 24 and inner wall 26.

The shape, dimensions and number of webs 40*a*, 40*b*, 40*c*, 40*d* may vary. Preferably, webs 40*a*, 40*b*, 40*c*, 40*d* are generally rectangular in shape and are generally the same size. Webs 40*a*, 40*b*, 40*c*, 40*d* preferably have a length between about 2 inches and about 3 inches, and more preferably about 2½ inches. The webs 40*a*, 40*b*, 40*c*, 40*d* preferably have a height between about 7 inches and about 9 inches, and more preferably about 8 inches.

As shown in FIGS. 1 and 2, the preferred arrangement of webs 40*a*, 40*b*, 40*c*, 40*d* is first web 40*a* positioned between first outer wall 22 and inner wall 26 at about 8 inches from first short side 30*a* of first outer wall 22, second web 40*b* positioned between first outer wall 22 and inner wall 26 at about 16 inches from first short side 30*a* of first outer wall 22, third web 40*c* positioned between inner wall 26 and second outer wall 24 at about 4 inches from first short side 30*c* of second outer wall 24 and fourth web 40*d* positioned between inner wall 36 and second outer wall 24 at 12 inches from first short side 30*c* of second outer wall 24.

Webs 40*a*, 40*b*, 40*c*, 40*d* should be of adequate thickness so that they may facilitate stability in molding and so that they may provide adequate load bearing surface when blocks are stacked. Webs 40*a*, 40*b*, 40*c*, 40*d* preferably have a thickness between about ½ inch and 2½ inches, and more preferably about 1 inch. As with the walls 20, it is preferred that the web thickness be uniform, but webs 40*a*, 40*b*, 40*c*, 40*d* may be tapered if desired to facilitate molding operations during block manufacturing.

Additionally, in the preferred arrangement webs 40*a*, 40*b*, 40*c*, 40*d* and walls 22, 24, 26 form apertures 50 so as to allow for alignment of apertures 50 when like blocks are assembled. Rounded aperture corners 52 are preferred, though other shapes or treatments may be utilized.

in the preferred embodiment shown in FIG. 2, distance W between outer face 31*a* of outer wall 22 and outer face 31*c* of outer wall 24 is preferably about 8 inches. In the preferred embodiment shown in FIG. 2, linear path L1 from point A to point B is about 12 inches, which is about a 50% increase in distance W between outer face 31*a* of outer wall 22 and outer face 31*c* of outer wall 24. This may result in reduction of the transmission of thermal and acoustic energy through block 10. Similarly, paths L2 and L3 are also about 12 inches, which is about a 50% increase in distance W.

In the preferred embodiment shown in FIGS. 1-3, first outer wall 22 has similarly shaped projections 60 on its second long side. Preferably, projections 60 have a trapezoidal cross-section, but the shape and positioning of the projections may vary.

First outer wall 22 has recesses 62 on its first long side 30*a* which are configured and positioned to receive projections 60 from a like block. Preferably, recesses 62 have a trapezoidal cross-section, but the shape and positioning of recesses 62 may vary, so long as projections 60 and recesses 62 may align when like blocks are stacked. Different sizes and shapes may be used for projections 60 and recesses 62 so long as the design may facilitate a close, interlocking fit.

Projections 60 and recesses 62 may interlock to allow like blocks to self-align when stacked, which may provide lateral strength and stability so that the blocks may be assembled without mortar. Accordingly, the blocks may be assembled without the need of trained masonry artisans which may reduce the cost of labor and the time of assembly.

It is preferred that trapezoidal projections 60 and recesses 62 be oriented so that the longer side of the trapezoid aligns with outer face 31*a* and the shorter side of the trapezoid aligns with inner face 33*a*. This may enable easier assembly when inserting projection 60 of one block into recess 62 of another like block.

Figure 4:
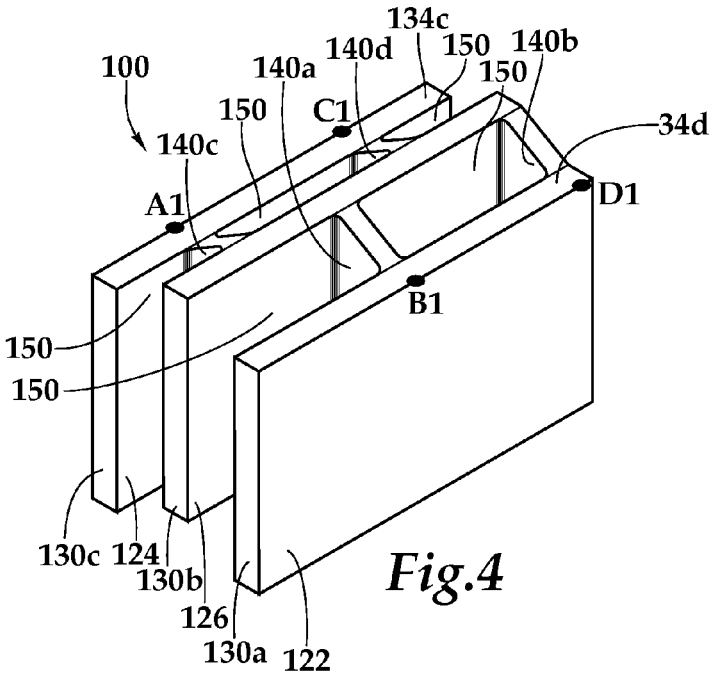
FIG. 4 is a perspective view of a construction block of another embodiment of the invention.
Figure 5:
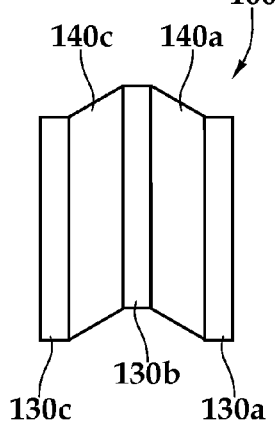
FIG. 5 is an end view of the construction block of FIG. 4.

FIGS. 4 and 5 show another embodiment of the invention. The construction block 100 of FIGS. 4 and 5 includes three generally rectangular walls 122, 124, 126 and four webs 140*a*, 140*b*, 140*c*, 140*d*.

While the dimensions of the embodiment shown in FIGS. 4 and 5 may vary, the preferred dimensions of the walls 122, 124, 126 are the same as those set forth above with respect to the embodiment shown in FIGS. 1-3.

In the embodiment of FIGS. 4 and 5, the first short sides 130 of walls 122, 124, 126 are generally in the same plane. First long sides 134 of outer walls 122 and 124 are generally in the same plane, and first long side 130 of inner wall 126 is offset from first long sides 130 of said outer walls 122 and 124.

As shown in FIG. 4, inner wall 126 may be vertically offset from outer walls 122 and 124, e.g., inner wall 126 may be positioned above or below outer walls 122 and 124. The distance of the offset may vary, but preferably inner wall 126 is offset by a distance between about ½ inch and about 1½ inches, and more preferably by a distance of about 1 inch. When like blocks are stacked, the offset inner wall 126 may allow the blocks to self-align. Also, the offset inner wall 126 may provide lateral strength and stability. Thus, like blocks may be stacked without the use of mortar, which may eliminate the need for a skilled artisan and which may in turn reduce the cost of labor and the time of assembly.

Though the arrangement of the webs 140*a*, 140*b*, 140*c*, 140*d* may vary, the preferred arrangement of webs 140*a*, 140*b*, 140*c*, 140*d* for the embodiment of FIGS. 4 and 5 is the same as the arrangement shown in the embodiment of FIGS. 1-3. As with the embodiment of FIGS. 1-3, the preferred web arrangement provides increased linear paths from outer wall 124 to outer wall 122 between any two of points A1, B1, C1 and D1, which may reduce the transmission of acoustic and thermal energy. Preferably, the length of each linear path is at least about 10% greater than the shortest distance between outer face 131*a* of outer wall 122 and outer face 131*b* of outer wall 124, i.e., the width of the block, and more preferably is about 25% greater, and still more preferably is about 50% greater.

While the shape and dimensions of webs 140*a*, 140*b*, 140*c*, 140*d* may vary, it is preferred that webs 140*a*, 140*b*, 140*c*, 140*d* are generally in the shape of a parallelogram and are generally the same size, as shown in FIG. 5. Webs 140*a*, 140*b*, 140*c*, 140*d* preferably have a length between about 2 inches and about 3 inches, and more preferably about 2½ inches. Webs 140*a*, 140*b*, 140*c*, 140*d* preferably have a height between about 7 inches and about 9 inches, and more preferably about 8 inches.

Webs 140*a*, 140*b*, 140*c*, 140*d* should be of adequate thickness so that they may facilitate stability in molding and they may provide adequate load bearing surface when like blocks are stacked. Webs 140*a*, 140*b*, 140*c*, 140*d* preferably have a thickness between about ½ inch and 2½ inches, and more preferably about 1 inch. As with walls 122, 124, 126, it is preferred that the web thickness be uniform, but webs 140*a*, 140*b*, 140*c*, 140*d* may be tapered to facilitate molding operations during block manufacturing Additionally, in the preferred arrangement webs 140*a*, 140*b*, 140*c*, 140*d* and walls 122, 124, 126 form apertures 150 so as to allow for alignment of the apertures when like blocks are assembled. Rounded aperture corners 152 are preferred, though other shapes or treatments may be utilized.

As is well known in the industry, variations of stretcher blocks are typically used to create corners, doorways, and windows, for example. Accordingly, the present invention includes variations of a stretcher block which are typically used when erecting a stricture. These may include, for example, a left-end sketcher block and a right-end stretcher block, a right-end half block and a left-end half block.

Figure 6:
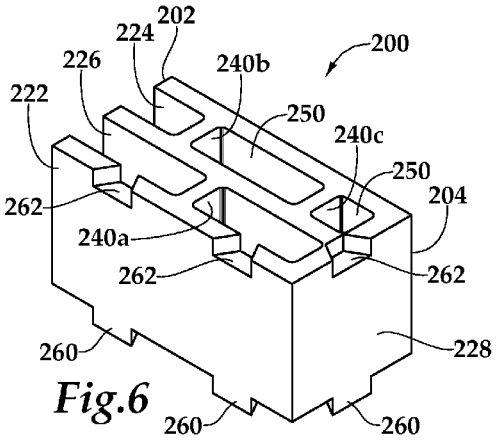
FIG. 6 is a perspective view of an embodiment of a right-end stretcher block of the current invention.
Figure 7:
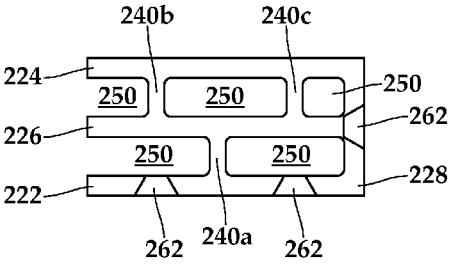
FIG. 7 is a top view of the block of FIG. 6.

FIGS. 6 and 7 show a right-end stretcher block 200, which is a variation of the embodiment shown in FIGS. 1-3. Block 200 has three generally parallel walls 222, 224, 226 consisting of outer walls 222, 224 and inner wall 226. It is preferred that inner wall 226 is generally centered between outer walls 222 and 224, though the positioning of inner wall 226 may vary. The preferred dimensions and positioning of walls 222, 224, 226 are the same as those discussed above with respect walls 22, 24, 26 of the embodiment shown in FIGS. 1-3. Block 200 has a first end 202 and a second end 204.

Block 200 of FIGS. 6 and 7 has three webs 240*a*, 240*b*, 240*c*, with web 240*a* positioned between and connecting outer wall 222 and inner wall 226, and webs 240*b* and 240*c* positioned between and connecting outer wall 224 and inner wall 226. The positioning and spacing of webs 240*a*, 240*b*, 240*c*, may vary, as discussed above with respect to the embodiment of FIGS. 1-3. The preferred arrangement is shown in FIGS. 6 and 7. The preferred dimensions of webs 240*a*, 240*b*, 240*c* are the same as those discussed above with respect to webs 40*a*, 40*b*, 40*c*, 40*d* of the embodiment shown in FIGS. 1-3. Webs 240*a*, 240*b*, 240*c* and walls 222, 224, 226, 228 form apertures 250 so as to allow for alignment of apertures 250 when like blocks are assembled. Rounded aperture corners 252 are preferred, though other shapes or treatments may be utilized.

As shown in FIGS. 6 and 7, an end wall 228 is located at second end 204 of block 200. End wall 228 connects walls 22, 224, 226 and is generally perpendicular to walls 222, 224, 226. Preferably, end wall 228 has about the same thickness and height as walls 222, 224, 226.

End wall 228 may have a projection 260 on a first side 270 and a recess 262 on a second side 272, as shown in FIGS. 6 and 7. The size, shape and positioning of projection 260 and recess 262 may vary as desired. Preferably, as with the embodiment shown in FIGS. 1-3, projection 260 and recess 262 have a trapezoidal cross-section and are generally centered on first side 270 and second side 272, respectively. Projections 260 and recess 262 may interlock to allow like blocks to self-align when stacked, which may provide lateral strength and stability.

Figure 8:
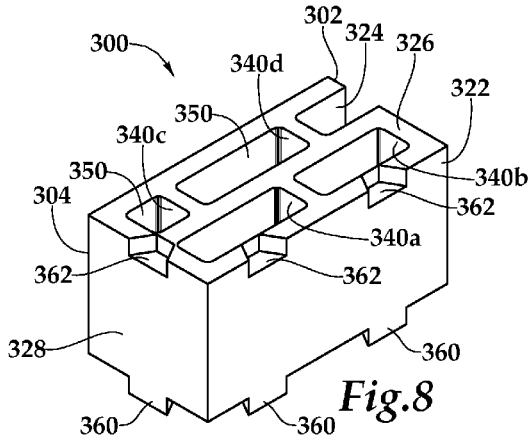
FIG. 8 is a perspective view of an embodiment of a left-end stretcher block of the current invention.
Figure 9:
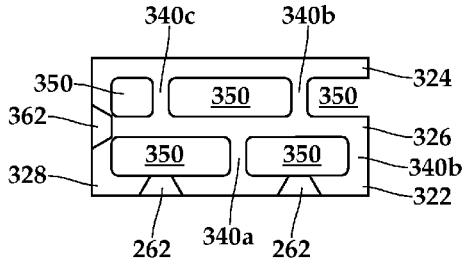
FIG. 9 is a top view of the block of FIG. 8.

FIGS. 8 and 9 show a left end stretcher block 300 having a first end 302 and a second end 304, outer walls 322, 324, inner wall 326, webs 340*a*, 340*b*, 340*c*, 340*d*, and end wall 328. The dimensions and positioning of walls 322, 324, 326 and weirs 340*a*, 340*b*, 340*c*, 340*d* are the same as the embodiment shown in FIGS. 1-3 as discussed above. It is preferred that end wall 328 have the same thickness and height as walls 322, 324, 326. As with the embodiment of FIGS. 6 and 7, end wall 328 may have a projection 160 and a recess 362 which may interlock when like blocks are stacked. Webs 340*a*, 340*b*, 340*c*, 340*d* and walls 322, 324, 326, 328 form apertures 350 so as to allow for alignment of apertures 350 when like blocks are assembled. Rounded aperture corners 352 are preferred, though other shapes or treatments may be utilized.

Figure 10:
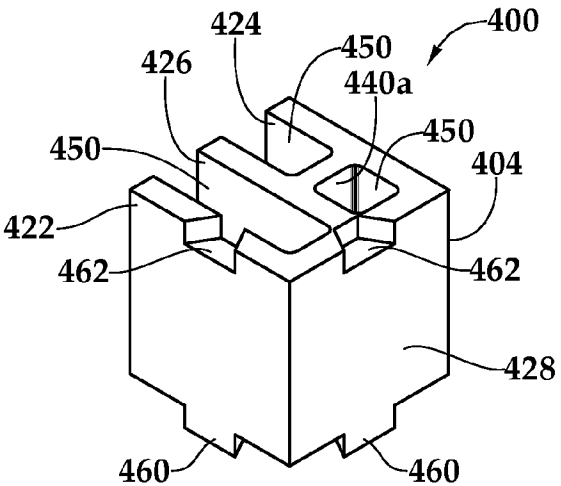
FIG. 10 is a perspective view of an embodiment of a right-end half block of the current invention.
Figure 11:
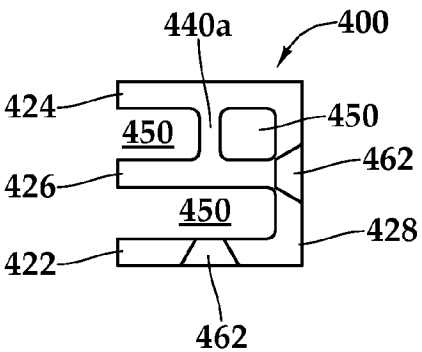
FIG. 11 is a top view of the block of FIG. 10.

FIGS. 10 and 11 show a right-end half block 400. As suggested by its name, right-end half block 400 is about one half of the right-end stretcher block 200 shown in FIGS. 6 and 7, i.e., from about the center of block 200 to second end 204. Accordingly, right-end half block 400 has outer walls 422, 424, web 440*a*, and end wail 428. As with end wall 228 of the embodiment of FIGS. 6 and 7, end wall 428 may have a projection 460 and a recess 462 which may interlock when like blocks are stacked. Block 400 has apertures 450 which may align when like blocks are assembled. Rounded aperture corners 452 are preferred, though other shapes or treatments may be utilized.

Figure 12:
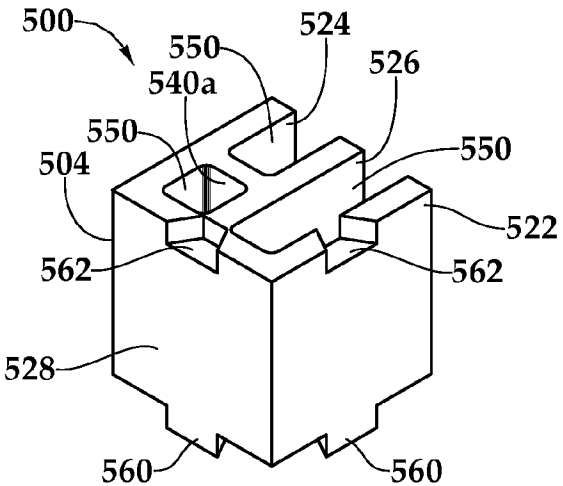
FIG. 12 is a perspective view of an embodiment of a left-end half block of the current invention.
Figure 13:
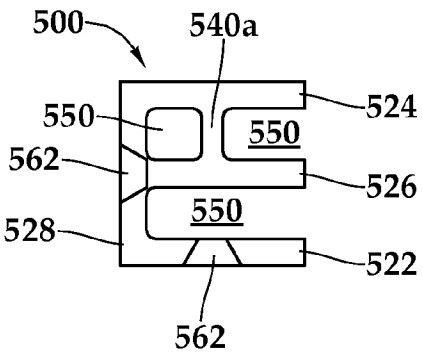
FIG. 13 is a top view of the block of FIG. 12.

FIGS. 12 and 13 show a left-end half block 400. As suggested by its name, left-end half block 500 is about one half of the left-end stretcher block 200 shown in FIGS. 8 and 9, i.e., from about the center of block 300 to first end 302. Accordingly, left-end half block 500 has outer walls 522, 524, web 540*a*, and end wall 528. As with end wall 328 of the embodiment of FIGS. 8 and 9, end wall 528 may have a projection 560 and a recess 562 which may interlock when like blocks are stacked. Block 500 has apertures 550 which may align when like blocks are assembled. Rounded aperture corners 552 are preferred, though other shapes or treatments may be utilized.

Figure 14:
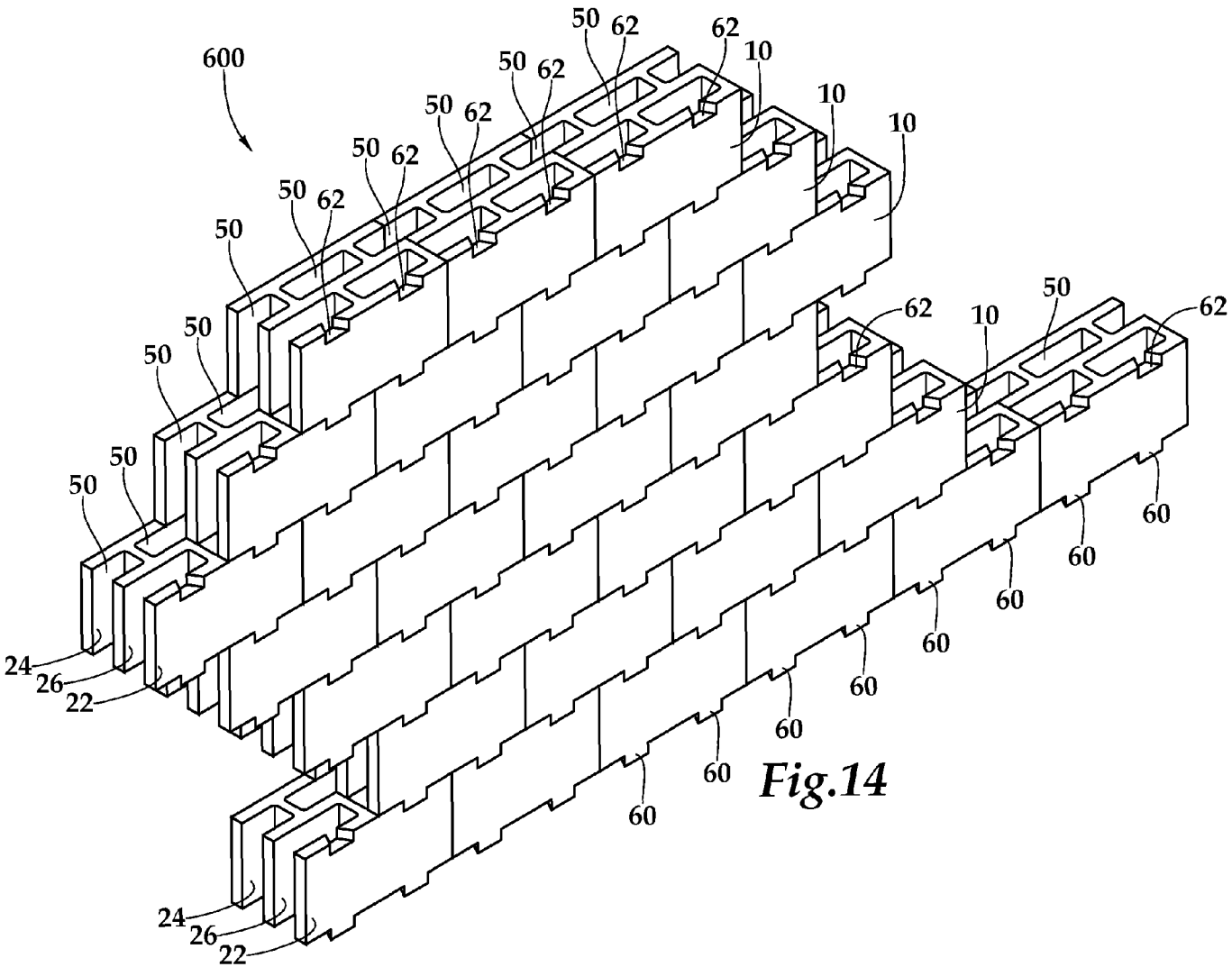
FIG. 14 is a perspective view of a wall assembly comprised of blocks shown in FIGS. 1-3.

FIG. 14 shows a wall assembly 600 using a plurality of construction blocks which are the same as the embodiment shown in FIGS. 1-3. As shown in FIG. 14, the preferred embodiment in assembling blocks 10 is to place blocks 10 with projections 62 facing downward and recesses 62 facing upward, and with outer wall 22 containing projections 60 and recesses 62 to be placed to the outside of an enclosed structure. Blocks 10 can be assembled with other placement orientations of the blocks, e.g., with projections 60 facing upward and recesses 62 facing downward, without affecting the objects of the invention, but the selected placement and orientation of the blocks must be consistently maintained throughout the assembly process.

Blocks 10 of the wall assembly of FIG. 14. are shown assembled in staggered courses, but they may also be assembled in vertical courses (not shown). To assemble the blocks into a structural wall, a base, e.g., a foundation or footing (not shown), should be prepared in advance. The base should be solid and level for the entire length of the structural wall to be assembled.

For assembly, projections 60 of the first or lower course of blocks 10 are removed (not shown) so that the course will be level, and so that any grout or insulating material that may be placed within the block apertures will be enclosed. The first or lower course of blocks 10 is then placed upon the previously prepared base so that each block is closely abutted with an adjacent block. The second course of blocks 10 is then placed upon the first course by raising each second course block into position and inserting projections 60 of the second course blocks into recesses 60 of the first course blocks 10. Block walls 22, 24 are then adjusted so that they are flush, true and plumb. Placement in this manner will ensure that block apertures 50 are in vertical alignment throughout the height of the structural wall as assembled. Apertures 50 may align to form a vertical shaft throughout the height of the wall, with the shaft having the same general dimensions as apertures 50. Successive courses are likewise assembled.

Figure 15:
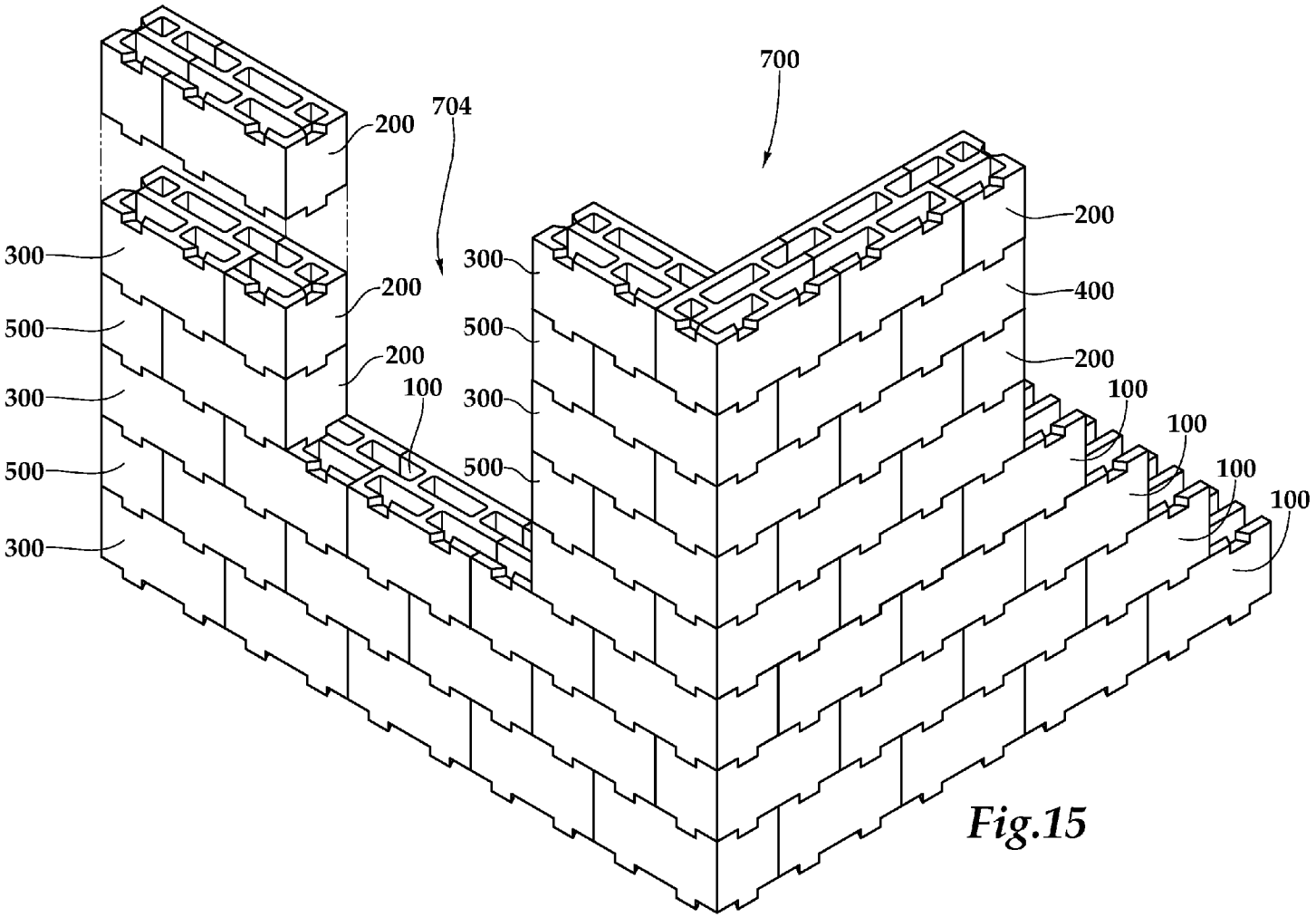
FIG. 15 is a perspective view of a wall assembly comprised of blocks shown in FIGS. 1-3, FIGS. 6-7, FIGS. 8-9, FIGS. 10-11, and FIGS. 12-13.

FIG. 15 shows a similar wall assembly 700 which includes stretcher block 100 of FIGS. 1-3, right-end stretcher block 200 of FIGS. 6-7, left-end stretcher block 300 of FIGS. 8-9, right-end half block 400 of FIGS. 1-11, and left-end half block 500 of FIGS. 12-13. The preferred method of assembly is the same as described above with respect to wall assembly 600 of FIG. 14. As shown, a combination of these blocks may be used to create a wall corner 702 or a wall opening 704.

In addition, the thermal and acoustic insulation qualities of the wall assemblies of FIGS. 14 and 15 may be enhanced by the addition of plastic, foam, glass fiber, rock wool, or other insulating materials placed within the aligned block apertures.

The assembled structural walls of FIGS. 14 and 15 may receive aesthetic treatments on either or both exterior wall surfaces, such as stucco, plaster, fiber reinforced coating, timber furring, stone, brick, tile, or the like, to enhance the appearance of the finished structure.

The construction block and wall assembly of this invention may be constructed of a variety of materials, e.g., various aggregate types and cementing substances, with, or without additives organic and inorganic plastic materials; cast, moldable or malleable metals; composite materials that are capable of being molded or otherwise shaped into the configurations of the invention. Preferably the invention is made of a cementitious material.

Where structural design requires vertical reinforcement, this may be accomplished by placing the reinforcement materials in the aligned apertures and by filling the aligned apertures with grout. Additionally, where a structural design requires vertical wiring or plumbing, the aligned apertures may serve as vertical raceways for any such wiring or plumbing.

Where structural design requires horizontal reinforcement, e.g., "bond beam" construction, an upper portion of the webs that are in horizontal alignment may be removed, and the reinforcement materials may be placed in the horizontal trough so formed and the trough may be filled with suitable grout material. Where the design requires horizontal installation of wiring or plumbing, an upper portion of the webs may be removed and, similarly, the wiring or plumbing may be installed in the trough so formed and may be secured in the horizontal trough by satisfactory means.

While the foregoing written description of the invention enables one of ordinary skill to make and use what is considered presently to be the best mode thereof, those of ordinary skill will understand and appreciate the existence of variations, combinations, and equivalents of the specific exemplary embodiments and methods herein. The invention should therefore not be limited by the above described embodiments and methods, but by ill embodiments and methods within the scope and spirit of the invention as claimed.

What is claimed is:

1. A construction block for vertical stacking comprising:

three generally rectangular walls of generally the same size that are spaced generally parallel to one another, two of said walls being a first outer wall and a second outer wall, each of said first and second outer walls has an inner face and an outer face, and one of said walls being an inner wall, said walls having a first short side, a second short side, a first long side and a second long side, wherein said first short sides of each of said walls are generally in the same plane, wherein said first long sides of each of said walls are generally in the same plane, wherein said second outer wall has at least one projection on its first long side and at least one recess on its second long side for receiving a similar projection, said at least one recess has a plurality of surfaces extending from said inner face to said outer face of said second outer wall;

at least four generally planar webs, said webs being generally perpendicular to said walls, wherein said webs are spaced generally parallel to one another, wherein two of said webs are positioned between said first outer wall and said inner wall so as to connect said first outer wall and said inner wall, and wherein two of said webs are positioned between said second outer wall and said inner wall so as to connect said second outer wall and said inner wall; and at least one end wall having an outer face and an inner face, said at least one end wall is perpendicular to and connects said first outer wall, said second outer wall and said inner wall, wherein said at least one end wall has at least one projection and at least one recess for receiving a similar projection, said at least one recess has a plurality of surfaces extending from said inner face to said outer face of said at least one end wall.

2. A construction block according to claim 1, wherein said block is made of cementitious material.

3. A construction block according to claim 1, wherein said inner wall is generally centered between said first outer wall and said second outer wall.

4. A construction block according to claim 1 wherein said at least one projection has a trapezoidal cross-section and said at least one recess has a trapezoidal cross-section.

* * * * *

UNITED STATES PATENT AND TRADEMARK OFFICE

CERTIFICATE OF CORRECTION

PATENT NO. : 7,882,674 B2
APPLICATION NO. : 11/608652
DATED : February 8, 2011
INVENTOR(S) : Joseph H. Craven et al.

It is certified that error appears in the above-identified patent and that said Letters Patent is hereby corrected as shown below:

On the Title page, Item (76)

The first name of inventor Joseph H. Craven is incorrectly listed as "Joseh" and should be corrected as "Joseph".

Signed and Sealed this
Twenty-ninth Day of March, 2011

David J. Kappos

David J. Kappos
*Director of the United States Patent and Trademark Office*